US011717976B2

(12) United States Patent
Seferi

(10) Patent No.: US 11,717,976 B2
(45) Date of Patent: Aug. 8, 2023

(54) BOX TOP OPENER

(71) Applicant: Acme United Corporation, Fairfield, CT (US)

(72) Inventor: Nicholas L. Seferi, Southbury, CT (US)

(73) Assignee: Acme United Corporation, Fairfield, CT (US)

( * ) Notice: Subject to any disclaimer, the term of this patent is extended or adjusted under 35 U.S.C. 154(b) by 50 days.

(21) Appl. No.: 17/206,704

(22) Filed: Mar. 19, 2021

(65) Prior Publication Data

US 2022/0297323 A1 Sep. 22, 2022

(51) Int. Cl.
*B26B 5/00* (2006.01)

(52) U.S. Cl.
CPC ..... *B26B 5/003* (2013.01); *B26B 5/005* (2013.01)

(58) Field of Classification Search
CPC ..... B26B 5/003; B26B 5/005; B26B 5/18; B26B 5/08; B26B 5/001; B26B 5/00; A61B 17/3211; A61B 17/32113; B26D 7/2657; B26D 7/2658
USPC ..... 30/163
See application file for complete search history.

(56) References Cited

U.S. PATENT DOCUMENTS 158,830 A * 1/1875 Buterworth ..... B26B 5/006 30/162
253,185 A * 2/1882 Christlmiller ..... B26B 5/006 30/162
1,406,156 A * 2/1922 Cotter ..... B29C 73/26 30/162
1,833,406 A * 11/1931 Bratrud ..... B26B 1/08 30/162
2,569,286 A * 9/1951 Bunker ..... B26B 1/00 30/340
2,885,779 A * 5/1959 Newkirk ..... B26B 1/08 30/162
3,518,758 A * 7/1970 Bennett ..... B26B 5/001 30/154
3,626,592 A * 12/1971 La Cas et al. ..... A61B 17/3213 D7/649
4,240,202 A * 12/1980 Gilbert ..... B26B 5/002 30/162
5,665,099 A * 9/1997 Pilo ..... A61B 17/3211 30/162
5,966,817 A * 10/1999 Lee ..... B26B 5/001 30/162
6,082,008 A * 7/2000 Lariviere, Jr. ..... B26B 1/00 30/294
6,796,033 B2 * 9/2004 Owoc ..... B26B 5/001 30/162
7,155,829 B1 * 1/2007 Sun ..... B26B 5/003 30/162
7,647,702 B2 * 1/2010 Polei ..... B26B 5/001 30/162
D668,525 S * 10/2012 Huang ..... B26B 5/006 D8/99

(Continued)

*Primary Examiner* — Evan H MacFarlane
*Assistant Examiner* — Fernando A Ayala
(74) *Attorney, Agent, or Firm* — Alix, Yale & Ristas, LLP

(57) ABSTRACT

A box top opener employs a trapezoidal ceramic blade having a cutting edge which is positionable at multiple positions. A knob is rotatable to extend and retract the blade. A guide projects from a front of the cutter body to provide a guide surface engageable against the top of a box. In one embodiment, a blade carrier has a follower which traverses a spiral track for displacing the blade.

18 Claims, 12 Drawing Sheets

(56) References Cited

U.S. PATENT DOCUMENTS

| | | | | |
|---|---|---|---|---|
| 9,919,435 | B1 * | 3/2018 | Enguita | E04F 21/00 |
| 10,569,433 | B1 * | 2/2020 | Wong | B26B 1/08 |
| 2003/0150117 | A1 * | 8/2003 | Owoc | B26B 5/001 30/162 |
| 2008/0250651 | A1 * | 10/2008 | Davis | B26B 5/003 30/162 |
| 2010/0024219 | A1 * | 2/2010 | Hernandez | B26B 5/003 30/162 |
| 2010/0024221 | A1 * | 2/2010 | Hernandez | B26B 5/003 30/296.1 |
| 2011/0041344 | A1 * | 2/2011 | De | B26B 5/001 30/162 |
| 2011/0283543 | A1 * | 11/2011 | Wu | B26B 5/001 30/162 |
| 2012/0017443 | A1 * | 1/2012 | Hao | B26B 1/046 30/161 |
| 2015/0073449 | A1 * | 3/2015 | Nallakrishnan | A61F 9/0133 606/167 |
| 2018/0290315 | A1 * | 10/2018 | Scimone | B26B 5/00 |
| 2021/0078354 | A1 * | 3/2021 | Araki | B43L 19/0068 |
| 2021/0245374 | A1 * | 8/2021 | Giles | B26B 1/10 |

* cited by examiner

BOX TOP OPENER

BACKGROUND

This application relates generally to utility knives. More particularly, this application relates to knives which are especially configured to open corrugated boxes and the like.

Numerous utility knives adapted to cut corrugated boxes have been proposed. Such conventional utility knives have incorporated features for extending and retracting the blade. The numerous conventional devices employ a wide variety of blade mounting structures and cooperating structures facilitating blade replacement and blade reversal. Some conventional utility knives have included features for guiding the utility knife during the cutting operation. The present box top opener is specifically adapted to provide a low cost and safe box top opener which can be employed in a highly efficient manner to sever the top of a corrugated box.

SUMMARY

Briefly stated, a box top opener comprises an elongated body having a first end with a frontal blade opening and an opposed second end. A guide extends forwardly at the first end. A blade positioning assembly has a blade carrier and a shank mounting a follower. A tubular receiver receives the shank and has an interior spiral track. The follower is positionable to follow the track. A knob extends outwardly at the second end and is rotatably coupled with the receiver. The knob is exteriorly manually rotatable and longitudinally displaceable. The knob is biased in a rearward longitudinal direction. The blade carrier is moveable between a first position and a second position by longitudinally displacing the knob and rotating the knob.

The guide is preferably a metal member having a divergent fan-like shape. The carrier fixedly receives a blade having a longitudinally oriented cutting edge. A portion of the cutting edge is extendable outwardly from the frontal blade opening. The blade is preferably a ceramic blade having a trapezoidal shape.

The knob preferably has a serrated surface with an arcuate end cap. A spring is disposed between the knob and the receiver and biases the knob rearwardly relative to the longitudinally fixed receiver. The knob has a tubular extension with at least one flat surface. The receiver has a second surface which engages the flat surface to rotatably couple the knob and the receiver. The knob is capable of limited longitudinal movement relative to the body. Rotating the knob in a first direction rotates the receiver and extends the blade carrier, and rotating the knob in a reverse direction retracts the blade carrier.

The knob is biased in a rearward position by a spring. The knob is depressible to allow the knob to be rotated. In one embodiment, an internal wall has four equiangularly spaced notches. The knob has a detent which is seated in a notch under the bias of the spring to prevent rotation of the knob unless the knob is longitudinally depressed.

The metal guide member extends forwardly and generally parallel to the blade. The metal guide member is adapted to engage against the top of a box and the frontal guide surface engages the side of the box to facilitate severing the box top.

DETAILED DESCRIPTION

Figure 1:
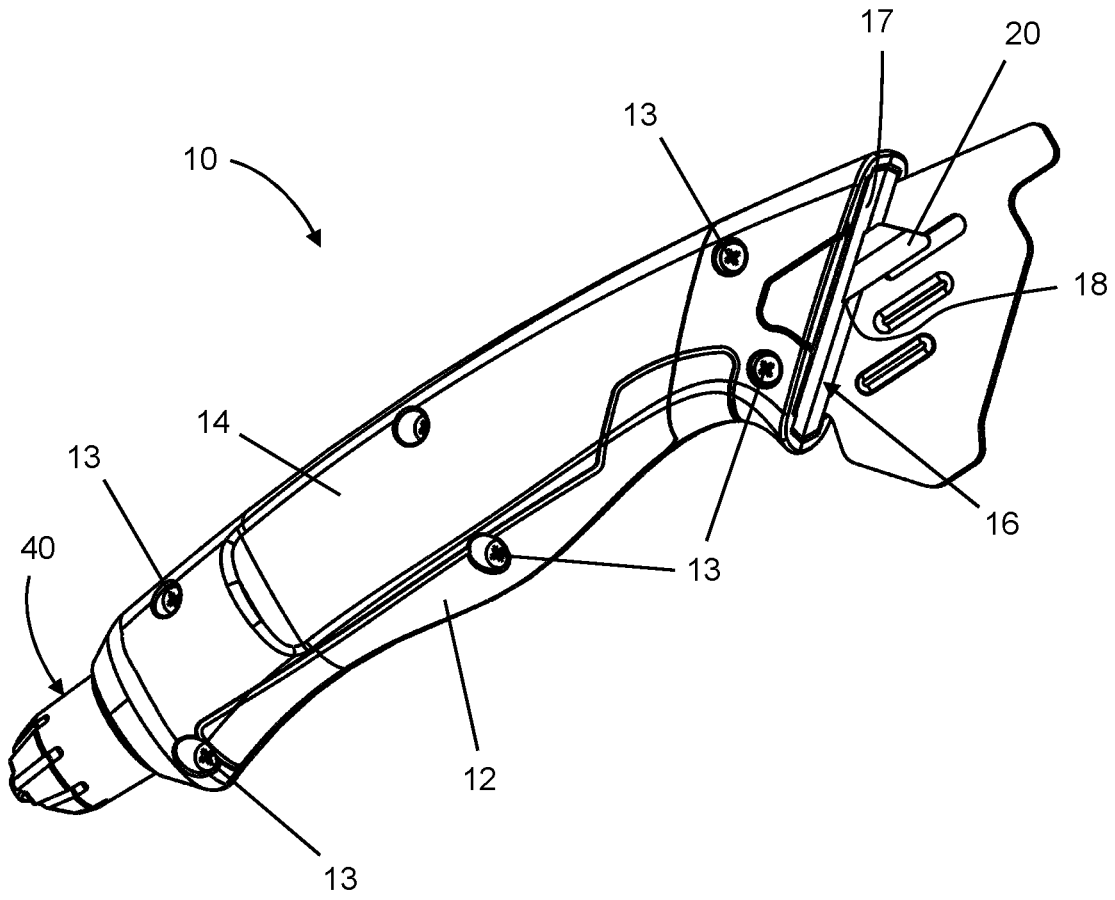
FIG. 1 is a perspective view of a box top opener with a blade disposed at a first position.
Figure 1A:
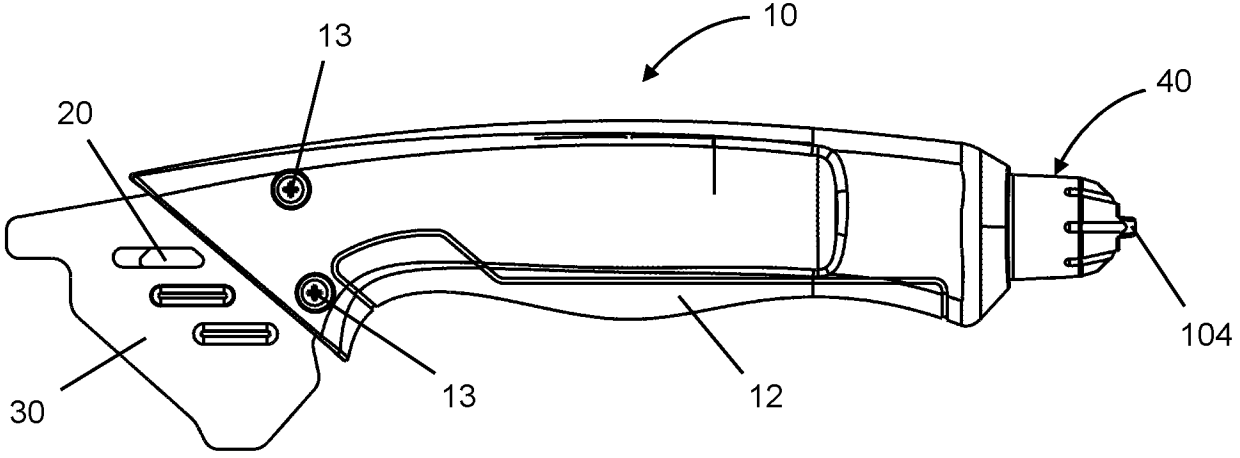
FIGS. 1A-1C are respectively a side view, an opposite side view and a bottom plan view of the box top opener of FIG. 1.
Figure 1B:
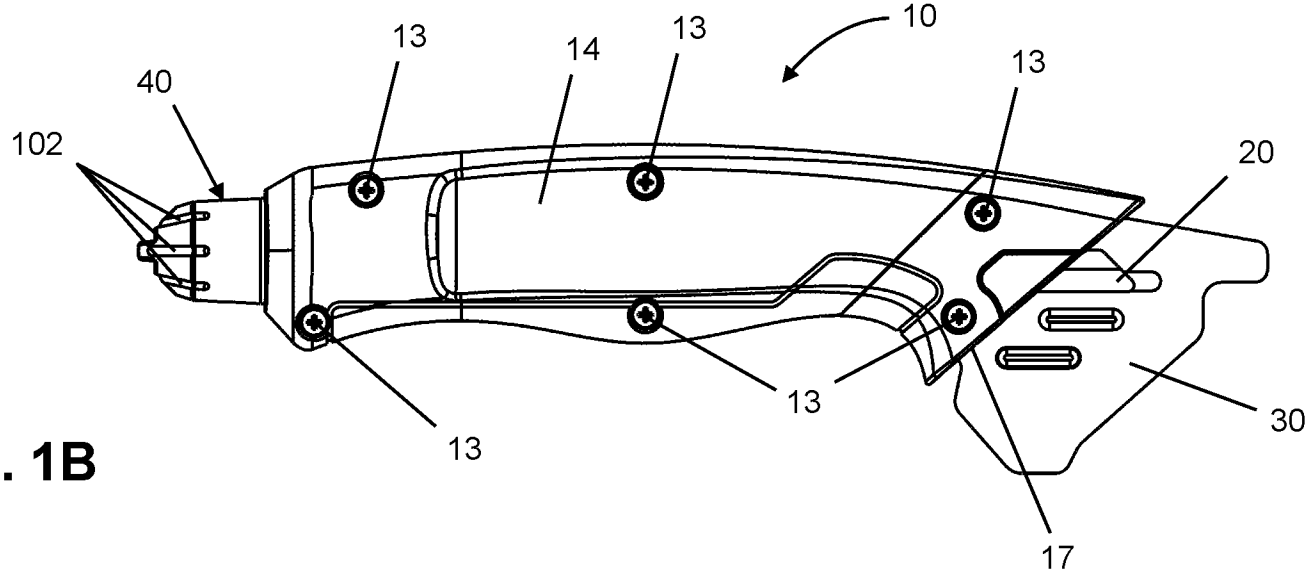
Figure 1C:
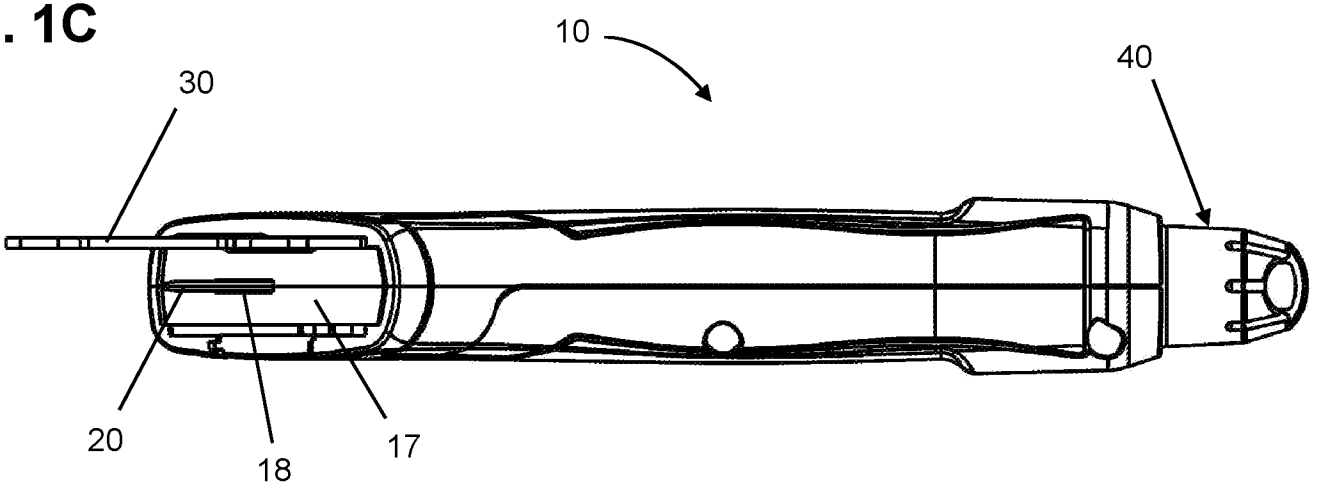
Figure 2:
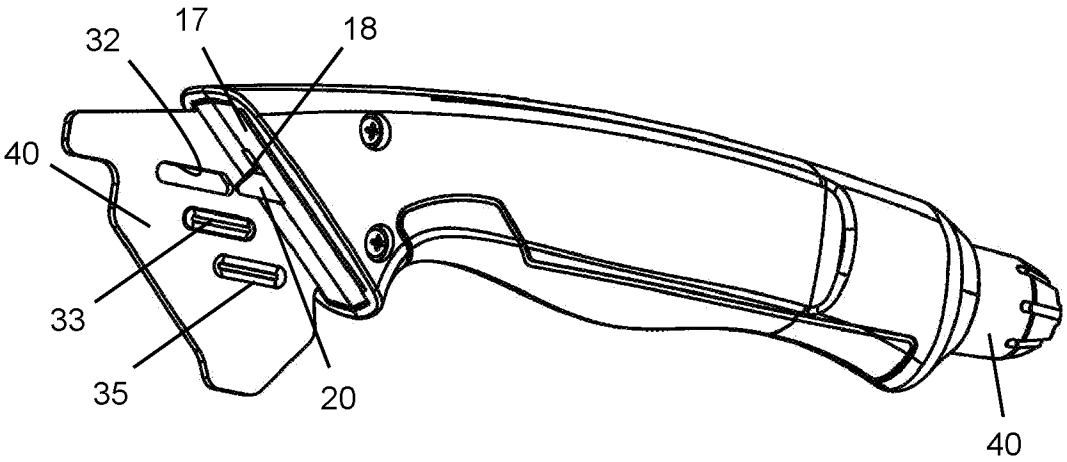
FIG. 2 is a perspective view of a box top opener with a blade disposed at a second position.
Figure 2A:
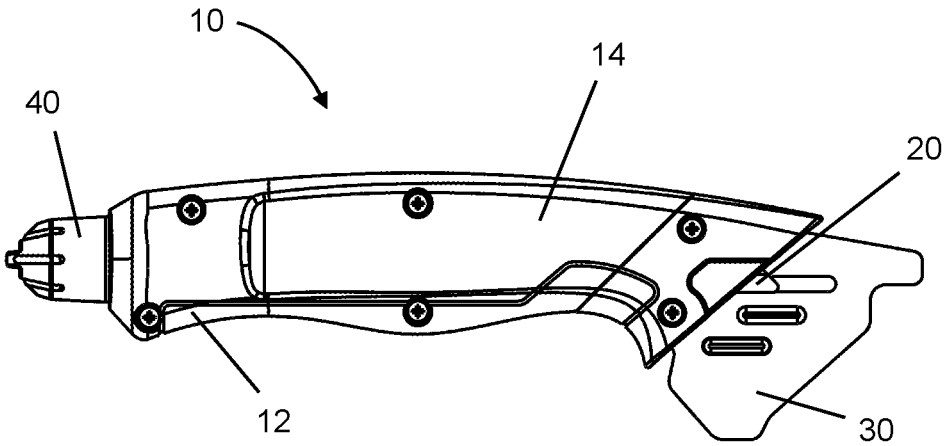
FIGS. 2A-2E are respectively a side view, a front end view, a rear end view, a bottom plan view and a top plan view of the box top opener of FIG. 2.
Figure 2B:
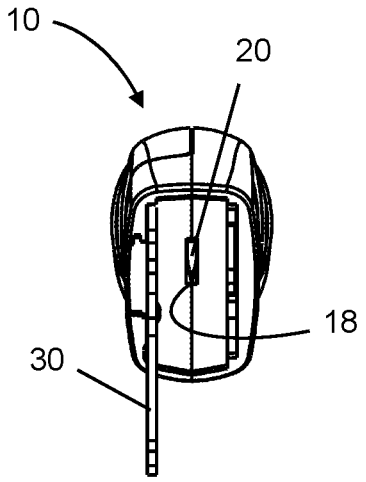
Figure 2C:
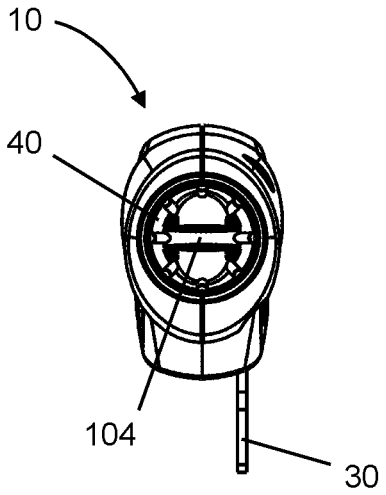
Figure 2D:
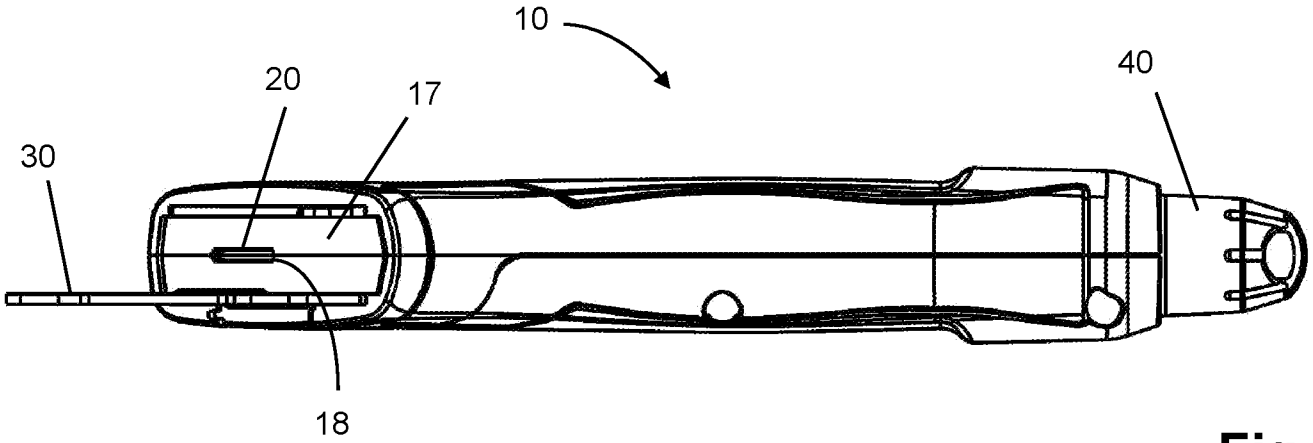
Figure 2E:
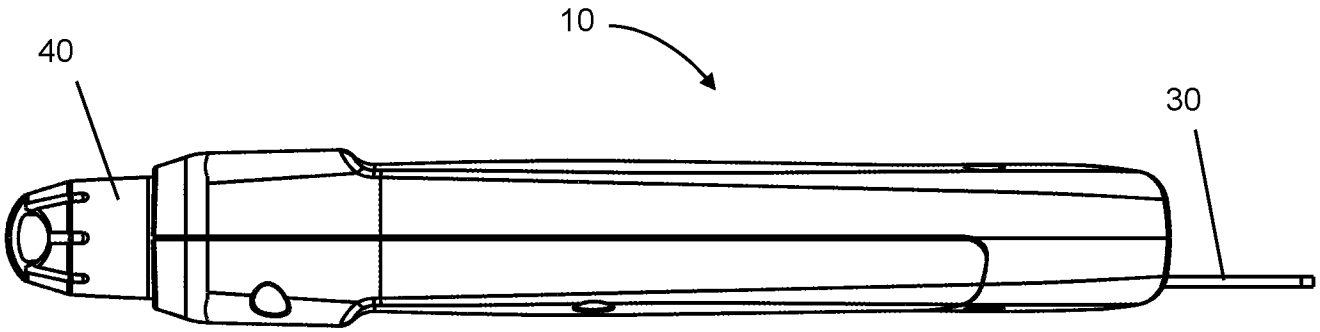

With reference to the drawings wherein like numerals represent like parts throughout the several figures, a utility knife in the form a box top opener is generally designated by the numeral 10. The box top opener is specifically configured to sever the top of a corrugated box in a highly efficient and safe manner. The box top opener preferably employs a ceramic blade 20 which is adjustably positionable at multiple forward extended positions, such as a first position shown in FIG. 1 and a second position shown in FIG. 2, and at a retracted position shown in FIG. 3. The box top opener includes a projecting frontal guide 30 which is adapted to engage the top of the box and allow for the blade to sever the box top from the box along a pre-established cutting path slightly spaced from the top.

The box top opener 10 includes a housing which is formed from a base section 12 and a cover 14 which mates with the base section to form the housing. The base section 12 and cover 14 are preferably plastic molded components. The cover 14 is secured to the base section by screws 13 which are threaded into bosses projecting from the base section interior. The frontal portion of the housing slidably receives a frontal assembly 16 which defines a frontal obliquely oriented, guide surface 17 having a blade opening 18. The frontal assembly 16 is secured at opposite sides of the base section by screws 13. The guide 30 is partially sandwiched between the frontal assembly 16 and the frontal enclosed portion of the base section 12 and secured by screws 13.

Figure 8A:
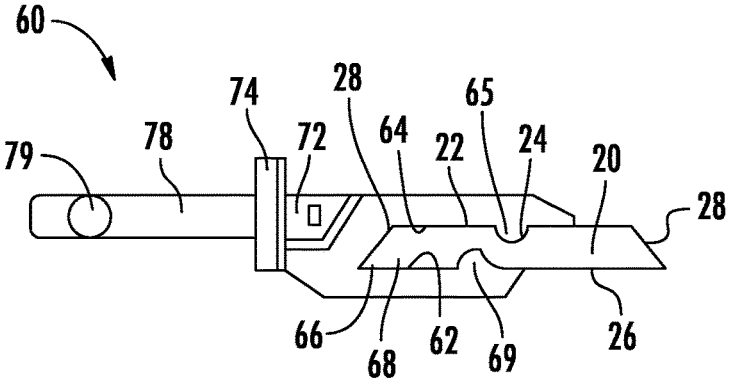
FIGS. 8A and 8B are respectively a side view and a top plan view of a blade carrier and a mounted blade for the box top opener of FIG. 1.
Figure 8B:
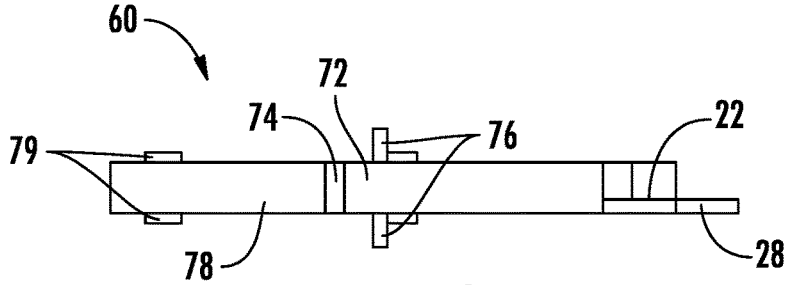
Figure 9:
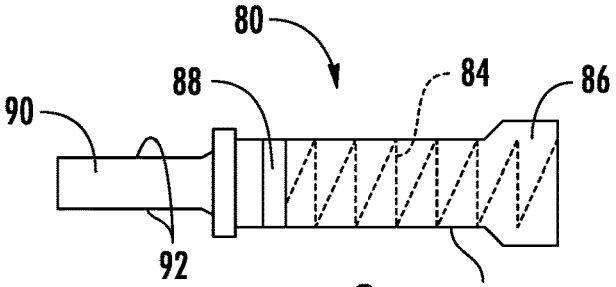
FIG. 9 is a side view, partly in phantom, of a receiver of the box top opener of FIG. 4.
Figure 10:
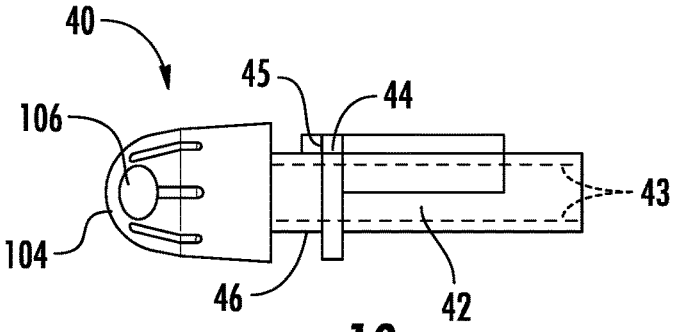
FIG. 10 is a side view, partly in phantom, of a knob of the box top opener portion of FIG. 4.

With reference to FIGS. 8A and 8B, the blade 20 preferably has a trapezoidal shape with an upper edge 22 interrupted by a medial notch 24. The larger lower edge 26 is sharpened and functions as the severing or cutting portion. Typically, only a portion of the edge 26 is exposed. The diagonal side edges 28 are alternately exposed and fixedly engaged since the blade may be reversed after usage for a period of time so that a sharper portion of edge 26 is exposed for cutting.

A projecting knob 40 extends from the rear of the box top opener. The knob 40 is depressible and rotatable to adjust the position of the frontally extendable blade 20, as will be described below.

The base section 12 includes integral lateral upstanding panels 52, 54 and 56 (FIGS. 4-7) which are longitudinally spaced at the section interior to provide support for, and effectively cradle, a blade positioning assembly 50, as will be detailed below. Each of the panels 52, 54 and 56 includes an aligned arcuate recess 53, 55 and 57, respectively, to engage, mount and support the blade positioning assembly 50. The cover section 14 likewise contains inwardly projecting support panels with arcuate recesses that align with panels 52, 54 and 56 respectively, and cooperatively engage and capture the blade positioning assembly upon fastening the cover 14 to the base section 12.

Figure 11:
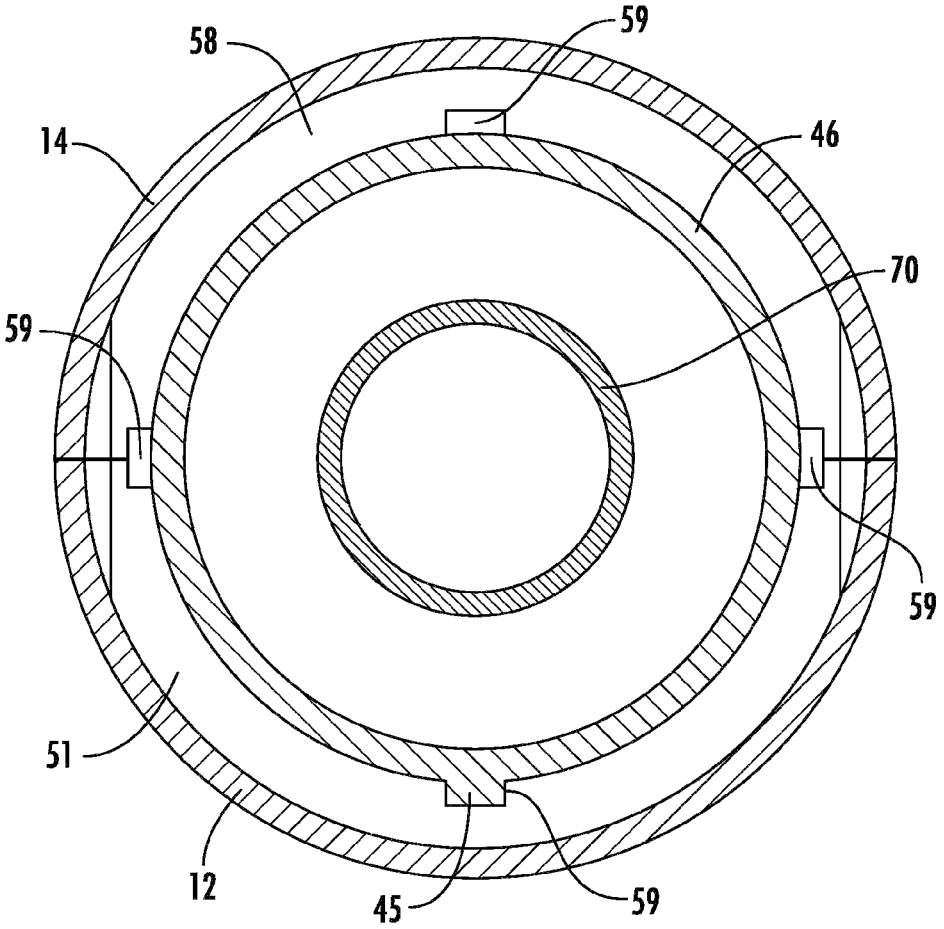
FIG. 11 is an enlarged sectional view of the box top opener, taken along the line 11-11 of FIG. 3A.

The base section 12 also has an integral rear compartment with a lateral wall 51 having an arcuate recess with a notch 59 (FIG. 11) for supporting and interacting with the knob 40 and limiting longitudinal and rotational movement of the knob. The opposing cover section 14 also includes a rear compartment and lateral wall 58 with an arcuate recess and a notch 59. The wall 58 aligns with and cooperates with the described compartment wall 51 of the base section 12 and supports and interacts with the knob 40, including limiting the longitudinal and rotational movement of the knob, as further described below. Walls 51 and 58 are configured so that the intersection of the walls also forms opposed notches 59. There are thus four equiangularly spaced notches 59 (see FIG. 11).

Figure 3:
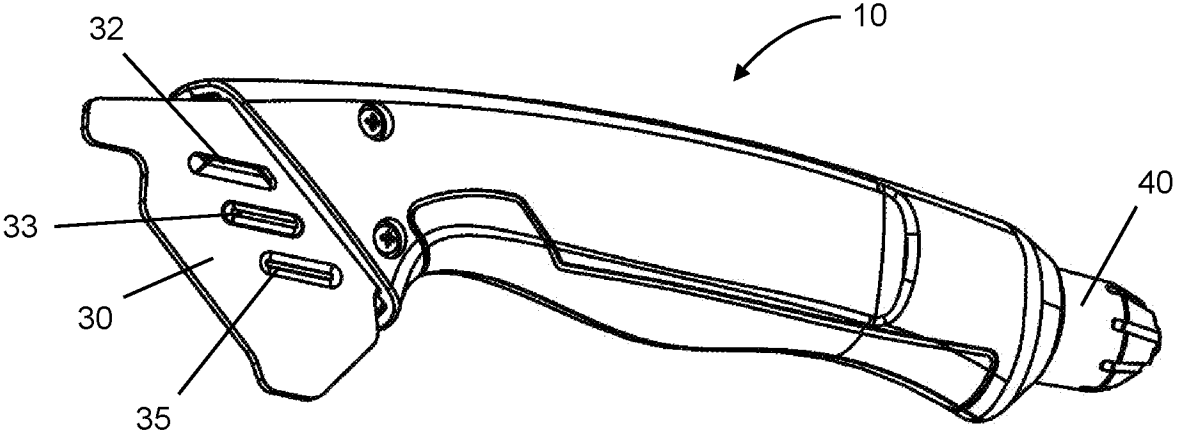
FIG. 3 is a perspective view of a box top opener with the blade disposed in a retracted position.
Figure 3A:
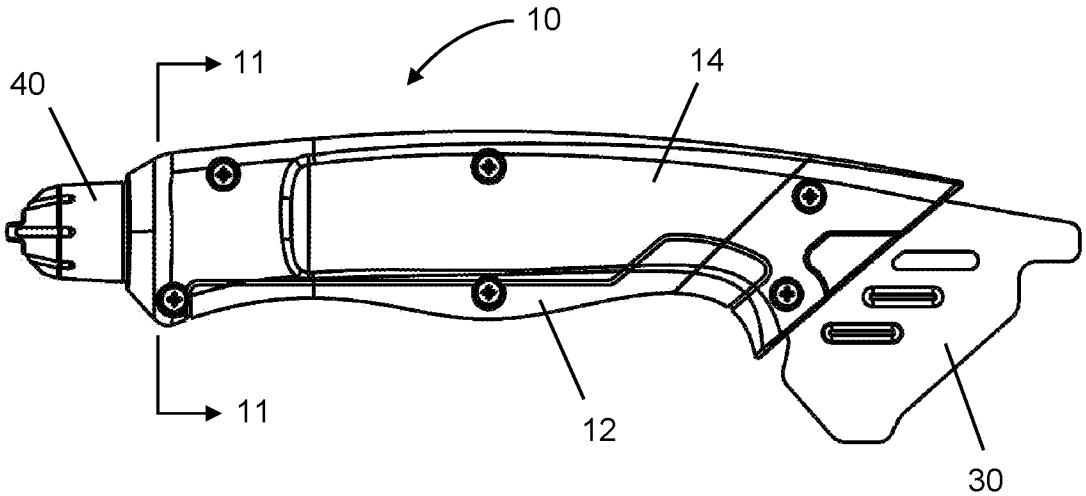
FIGS. 3A-3C are respectively a side view, a rear end view and a front end view of the box top opener of FIG. 3.
Figure 3B:
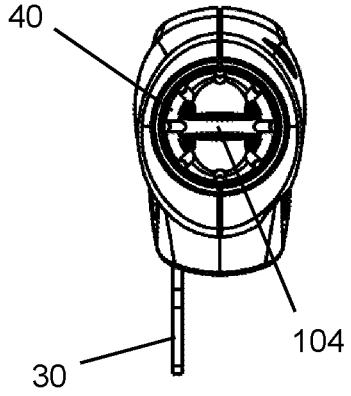
Figure 3C:
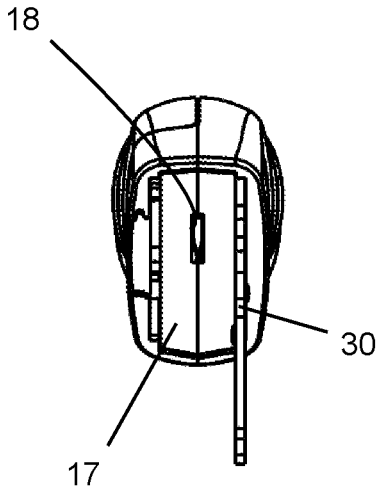
Figure 4:
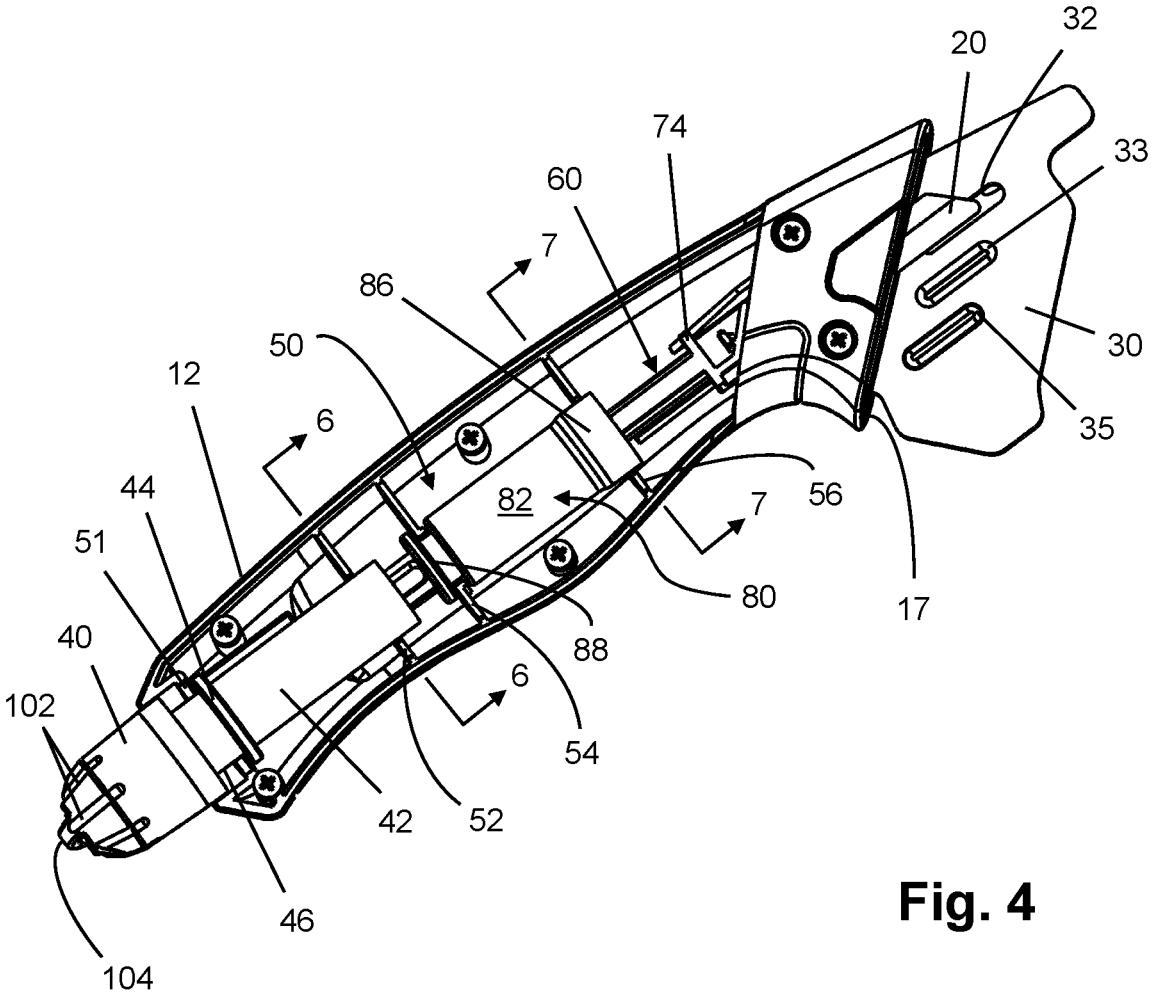
FIG. 4 is a side view of the box top opener of FIG. 1 with the cover removed.
Figure 5:
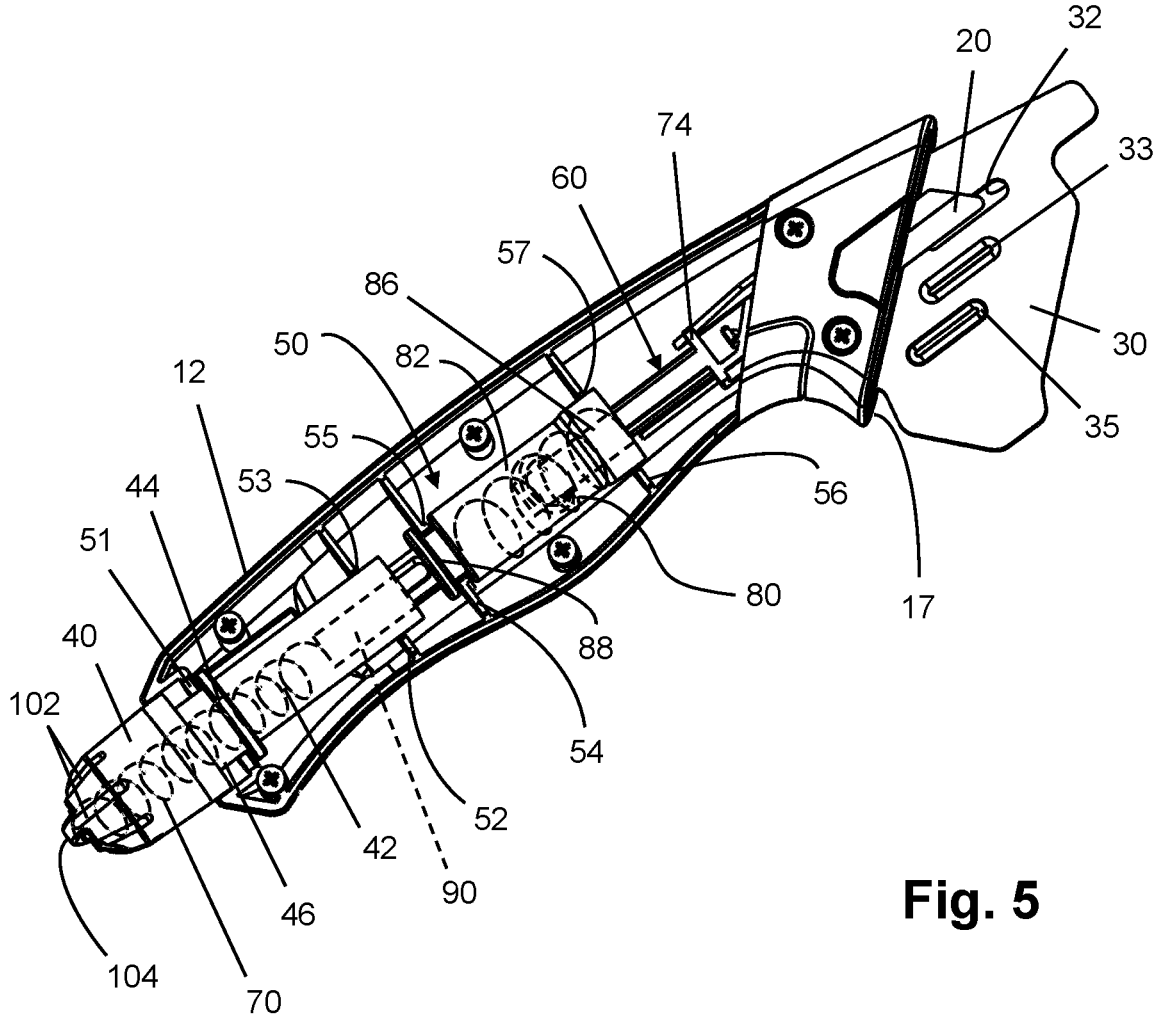
FIG. 5 is a side view, portions removed and portions shown in phantom, of the box top opener portion of FIG. 4.
Figure 6:
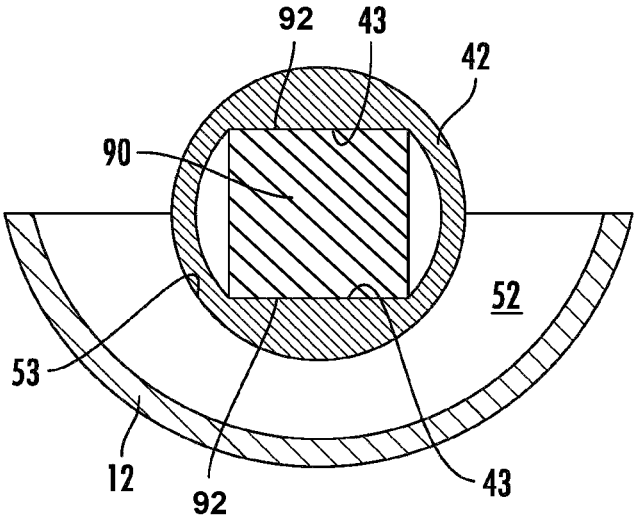
FIG. 6 is an enlarged sectional view taken along the line 6-6 of FIG. 4.
Figure 7:
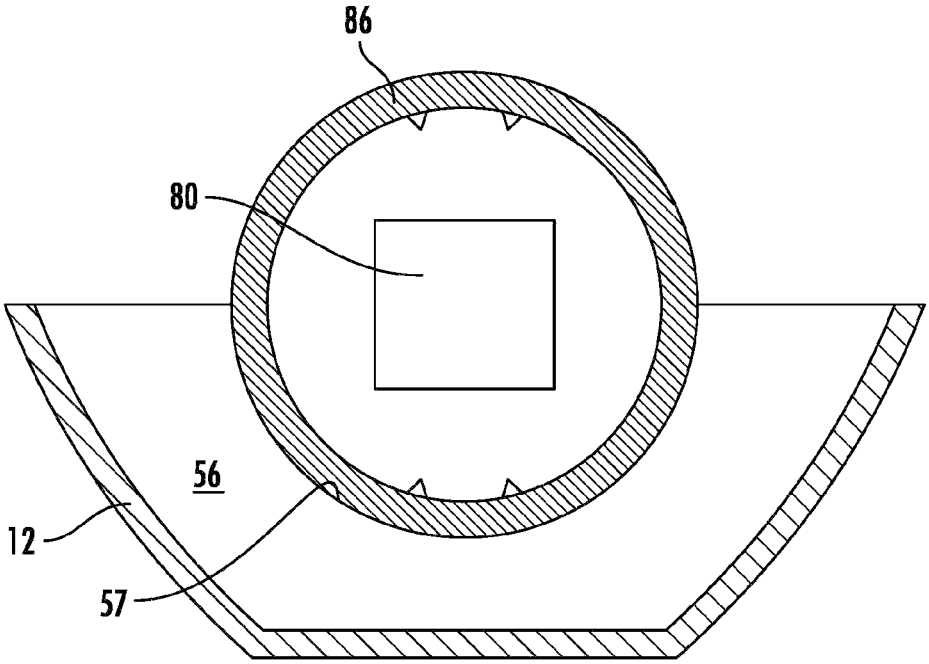
FIG. 7 is an enlarged sectional view taken along the line 7-7 of FIG. 4.

The blade positioning assembly 50 principally comprises a longitudinally moveable blade carrier 60, a longitudinally fixed receiver 80 and the knob 40 which is rotatably coupled with the receiver 80 and is rotatable and longitudinally displaceable relative to the housing comprising sections 12 and 14. The blade positioning assembly 50 functions to selectively extend the blade 20 through the blade opening 18 at multiple positions (FIG. 1, 2) and/or to retract the blade into the housing (FIG. 3).

With reference to FIGS. 8A and 8B, the blade carrier 60 includes a truncated trapezoidal recess 62 which receives and mounts the blade 20. The recess 62 includes a top edge 64 with a projection 65 and a rear diagonal edge 66, respectively, which engage the top edge 22, notch 24 and rear edge 28 of the blade. A lower edge 68 includes a tab 69 which retains a bottom medial portion of the blade edge 26. The blade 20 is thus fixedly mounted to the carrier 60.

The carrier is slidably received in the frontal assembly 16 and moveable to extend a front portion of the blade through the frontal blade opening 18. The blade carrier 60 has an integral rearward extension 72. The rearward extension 72 includes an integral transversely projecting tab 74 and an integral laterally projecting stop 76. The tab 74 and the stop 76 limit the longitudinal travel of the blade carrier 60. An integral shank 78 extends rearwardly from the extension 72 and mounts a transversely projecting follower 79.

The receiver 80 has a tubular portion 82 with an interior spiral track 84. The follower 79 is received in and traverses the track upon rotation of the receiver 80 and thereby longitudinally moves the blade carrier 60. The receiver 80 functions to translate rotation of the receiver and the knob into longitudinal movement of the blade carrier 60 and the mounted blade 20.

The forward portion 86 of the receiver is slightly enlarged and is engaged and captured by the recess 57 of panel 56 and the opposing recess and panel at the interior of the cover 14. An annular slot 88 is disposed at an intermediate portion of the receiver. The annular slot 88 is captured in the arcuate recess 55 of panel 54 as well as the corresponding recess and panel of the cover. The foregoing slot/panel engagement longitudinally fixes the position of the receiver 80, but allows for rotation of the receiver. A rearward shank 90 of the receiver has opposed flat surfaces 92 which engage flat surfaces 43 to effectively rotatably couple the knob 40 to the receiver 80.

The knob 40 includes a forward integral coupling tube 42 which is traversed by opposed interior flat surfaces 43. An intermediate integral annular stop 44 is engageable against the lateral side of the compartment walls 51 and 58. A radial detent 45 projects rearwardly from the stop 44. At four angular positions, the detent 45 aligns and snaps into or seats in a notch 59. A longitudinally extending annular recess 46 allows the knob to be longitudinally displaced a distance limited by the forward and rear surfaces defining the recess 46 and engagement with walls 51 and 58.

A spring 70 is interposed in the coupling tube 42 of the knob and engaged against the end of the receiver shank 90 to bias the knob rearwardly so that the edge of the recess 46 normally engages the compartment wall 51 (when the detent 45 seats in a notch 59). The rear portion of the knob 40 includes a plurality of angularly spaced serrations 102 and a convex rear cap 104 which forms a transverse opening 106.

The knob, upon depression toward the front, allows the knob to rotate due to the release of the detent 45 from the notch 59. Upon rotation, the receiver rotates with the knob and causes the follower 79 to traverse the spiral track 84 and thus extend the blade carrier 60 so that the blade projects from the opening 18. When the knob is rotated in a counter direction, the follower 79 reverses its travel along the spiral track 84 and the blade carrier 60 is further retracted into the housing. A limit stop 74 on the blade carrier engages the end of the receiver 80 to limit travel. The longitudinal extension of the carrier is limited by the transverse stop 76.

The guide 30 includes an opening 32 which generally aligns with the blade upon extension and allows the blade to be viewed from the top of the guide when the guide is placed against the top of a box cover. The frontal guide 30 also preferably includes a pair of ribs 33 and 35. It will be appreciated that the guide 30 also provides a protective guard for the blade.

The blade 20 is parallel to the guide 30 and is offset a pre-established distance. The cover of a box (not illustrated) is thus easily severed by engaging the frontal surface 17 against a side of the box adjacent a top corner and forcing the blade to cut into the box by moving the opener around the perimeter of the upper cover side interface.

Since only a portion of the blade edge 26 is exposed for cutting, the non-exposed portion blade edge 26 can be repositioned for usage after the exposed portion is worn or becomes dull due to usage. The blade 20 can be reversed in the carrier by removing the screws 13 and pulling the frontal assembly 16 and the carrier 60 from the housing. The trapezoidal blade can then be flipped over and remounted to the carrier. The blade carrier 60 and frontal assembly 10 are then reinserted into the housing and the frontal assembly 16 is resecured by the screws 13.

While preferred embodiments of the foregoing have been set forth for purposes of illustration, the foregoing description should not be deemed a limitation of the invention herein. Accordingly, various modifications, adaptations and alternatives may occur to one skilled in the art without departing from the spirit and the scope of the present invention.

The invention claimed is:

1. A box top opener comprising:

an elongated body having a first end defining a frontal blade opening and an opposed second end including a structure defining at least one notch;

a guide extending forwardly at said first end;

a blade positioning assembly comprising:

a blade carrier configured to receive a blade, the blade carrier having a shank, the shank having a follower mounted to the shank;

a tubular receiver receiving said shank and having an interior spiral track wherein said follower follows said track;

a knob extending outwardly at said second end and rotatably coupled with said receiver, and exteriorly manually rotatable and longitudinally displaceable relative to said body, said knob being biased in a rearward longitudinal direction and including a detent;

a spring disposed between said knob and said receiver, said spring biasing the detent into engagement in said notch at an angular position of said knob, so that said blade carrier is moveable between a first position and a second position by longitudinally displacing said knob and rotating said knob.

2. The box top opener of claim 1 wherein said guide is a substantially planar metal member having a divergent shape in a plane parallel to the blade.

3. The box top opener of claim 1 wherein the blade received in said carrier includes a cutting edge disposed in a fixed position relative to the carrier a portion of said cutting edge is extendable outwardly from said frontal blade opening.

4. The box top opener of claim 3 wherein said blade has a trapezoidal shape.

5. The box top opener of claim 4 wherein said blade is manufactured from a ceramic material.

6. The box top opener of claim 1 wherein said knob has a serrated surface with an arcuate end portion.

7. The box top opener of claim 1 wherein said knob has a tubular extension with at least one flat surface and said receiver has a rearward shank with a second surface which engages said flat surface to rotatably couple the knob and the receiver and allow for limited longitudinal movement of the knob relative to the body and the receiver, longitudinal movement of the knob limited by contact between the knob and internal walls of the elongated body received in said recess.

8. The box top opener of claim 1 wherein rotating the knob in a first direction extends the blade carrier and rotating the knob in a reverse direction retracts the blade carrier.

9. A box top opener comprising:

an elongated body having a first end and an opposed second end;

a guide surface disposed at said first end and defining a frontal blade opening;

a positioning guide extending forwardly at said first end;

a blade having a cutting edge;

a blade positioning assembly comprising:

a blade carrier configured to receive said blade, said blade carrier and having a shank with a follower;

a longitudinally fixed tubular receiver receiving said shank and having an interior spiral track and said follower is positionable to follow said track;

a knob extending outwardly at said second end rotatably coupled with said receiver and exteriorly manually rotatable and longitudinally displaceable relative to said body, said knob being biased in a rearward longitudinal direction;

wherein said knob has a tubular extension with a first coupling surface and said receiver has a second coupling surface which engages said first coupling surface to rotatably couple the knob and the receiver and allow for limited longitudinal movement therebetween, so that said carrier is moveable between a first position and a second position by longitudinally displacing said knob and rotating said knob.

10. The box top opener of claim 9 wherein said positioning guide is a metal member parallel to said blade.

11. The box top opener of claim 9 wherein the blade received in said carrier has a cutting edge disposed in a fixed position therewith and wherein a portion of said cutting edge is extendable outwardly from said frontal blade opening.

12. The box top opener of claim 9 wherein said knob has a stop and a radial detent, said body has a wall defining a notch and said detent is seatable in said notch and said stop is engageable against said wall.

13. The box top opener of claim 12 wherein a spring is disposed between said knob and said receiver and biases said stop into engagement against said wall when said detent is seated in said notch.

14. The box top opener of claim 9 wherein rotating the knob in a first direction extends the blade carrier and rotating the knob in a reverse direction retracts the blade carrier.

15. A box top opener comprising:

an elongated body having a first end defining a frontal blade opening and an opposed second end;

a generally trapezoidal shaped blade;

a blade positioning assembly comprising:

a blade carrier mounting said blade and configured to position said blade at multiple exposed positions relative to said blade opening and connecting with a follower;

a longitudinally fixed receiver having a spiral track with said follower being positionable to follow said track;

a knob extending outwardly at said second end rotatably coupled to said receiver for rotation with said receiver and exteriorly manually rotatable;

so that said blade is moveable between a first position and a second position by longitudinally displacing said knob relative to said receiver and rotating said knob.

16. The box top opener of claim 15 further comprising a metal guide member extending forwardly at said first end and being generally parallel to said blade.

17. The box top opener of claim 15 wherein said knob has a detent which is temporarily seated at an angular position of said knob and is biased in a rearward position by a spring and wherein said knob is depressible to unseat said detent and to allow the knob to be rotated.

18. The box top opener of claim 17 wherein rotating the knob in a first direction longitudinally extends the blade and rotating the knob in a reverse direction longitudinally retracts the blade.

* * * * *